US005211710A

United States Patent [19]

Nagano

[11] Patent Number: 5,211,710

[45] Date of Patent: May 18, 1993

[54] METHOD OF KNITTING USING KNITTING EXTENSION

[76] Inventor: Seiko Nagano, 42-12, Akatsutsumi 5-chome, Setagaya-ku, Tokyo, Japan

[21] Appl. No.: 753,763

[22] Filed: Sep. 3, 1991

[51] Int. Cl.[5] ..... D04G 31/00

[52] U.S. Cl. ..... 66/118; 66/1 A

[58] Field of Search ..... 66/118, 1 A

[56] References Cited

U.S. PATENT DOCUMENTS

| | | | |
|---|---|---|---|
| 1,490,176 | 4/1924 | Mason et al. | 66/1 A |
| 2,093,631 | 9/1937 | Burnham | 66/118 X |
| 2,217,524 | 10/1940 | Neuschwanger et al. | 66/118 |
| 3,678,712 | 7/1972 | Singleton | 66/118 |
| 4,607,505 | 8/1986 | Dünker et al. | 66/1 A X |
| 4,630,454 | 12/1986 | Seremjian | 66/118 X |

FOREIGN PATENT DOCUMENTS

| | | | |
|---|---|---|---|
| 13279 | 5/1910 | Denmark | 66/118 |
| 976717 | 3/1951 | France | 66/118 |
| 19841 | of 1900 | United Kingdom | 66/1 A |
| 405130 | 2/1934 | United Kingdom | 66/118 |
| 2100295 | 12/1982 | United Kingdom | 66/1 A |

*Primary Examiner*—Clifford D. Crowder
*Assistant Examiner*—John J. Calvert
*Attorney, Agent, or Firm*—Jordan and Hamburg

[57] ABSTRACT

A knitting method employing a hooked needle having a hook at one end and a knitting extension of a flexible string material fixedly coupled to the other end. The extension has a predetermined length and thickness. In the method, chain stitches are first made with the needle and transferred to the extension. The front end of the needle is then inserted into each chain stitch of the row of chain stitches, while threading over and drawing the thread of the chain stitches or another material through the chain stitch, to form a succession of crochet stitches on the need. These stitches are transferred to the extension. The latter steps are then repeated.

2 Claims, 10 Drawing Sheets

METHOD OF KNITTING USING KNITTING EXTENSION

BACKGROUND OF THE INVENTION

The present invention relates to a method of knitting with the use of a hooked needle.

Common methods of knitting are known using knitting needles or a crochet hook.

Knitting with two or more knitting needles requires skill to manipulate the knitting sticks. Also, a stitch(s) of thread tends to slip off the knitting needle during knitting and once removed, is recovered only with difficulty.

For knitting a longer or round texture, more than three knitting needles are used. Hence, the foregoing disadvantages are emphasized thereby diminishing the pleasure of knitting.

In addition, because of the need for intricate manipulation of the knitting needles knitting using knitting needles is considered unsuitable for physically disabled people.

The method of knitting with a single crochet hook, in which rows of stitches are formed by pulling thread through a loop with the crochet hook or threading over, is rather easy in needle work, but it is difficult to thread over at the top of a crochet chain.

SUMMARY OF THE INVENTION

It is an object of the present invention, in view of the foregoing disadvantages, to provide a method of knitting in which the movements of threading over and making rows of stitches are facilitated with less possibility of slipping off of stitches and no outward projection of the knitting stick so that physically disabled people, as well as unskilled, people, can enjoy knitting with a certain degree of safety.

BRIEF DESCRIPTION OF THE DRAWINGS

This object and other objects and novel features of the present invention will fully be apparent from reading of the following description in conjunction of the accompanying drawings, wherein.

The drawings are intended only to simplify the description of the invention, and do not limit the scope of the invention.

DESCRIPTION OF THE PREFERRED EMBODIMENTS

Figure 1:
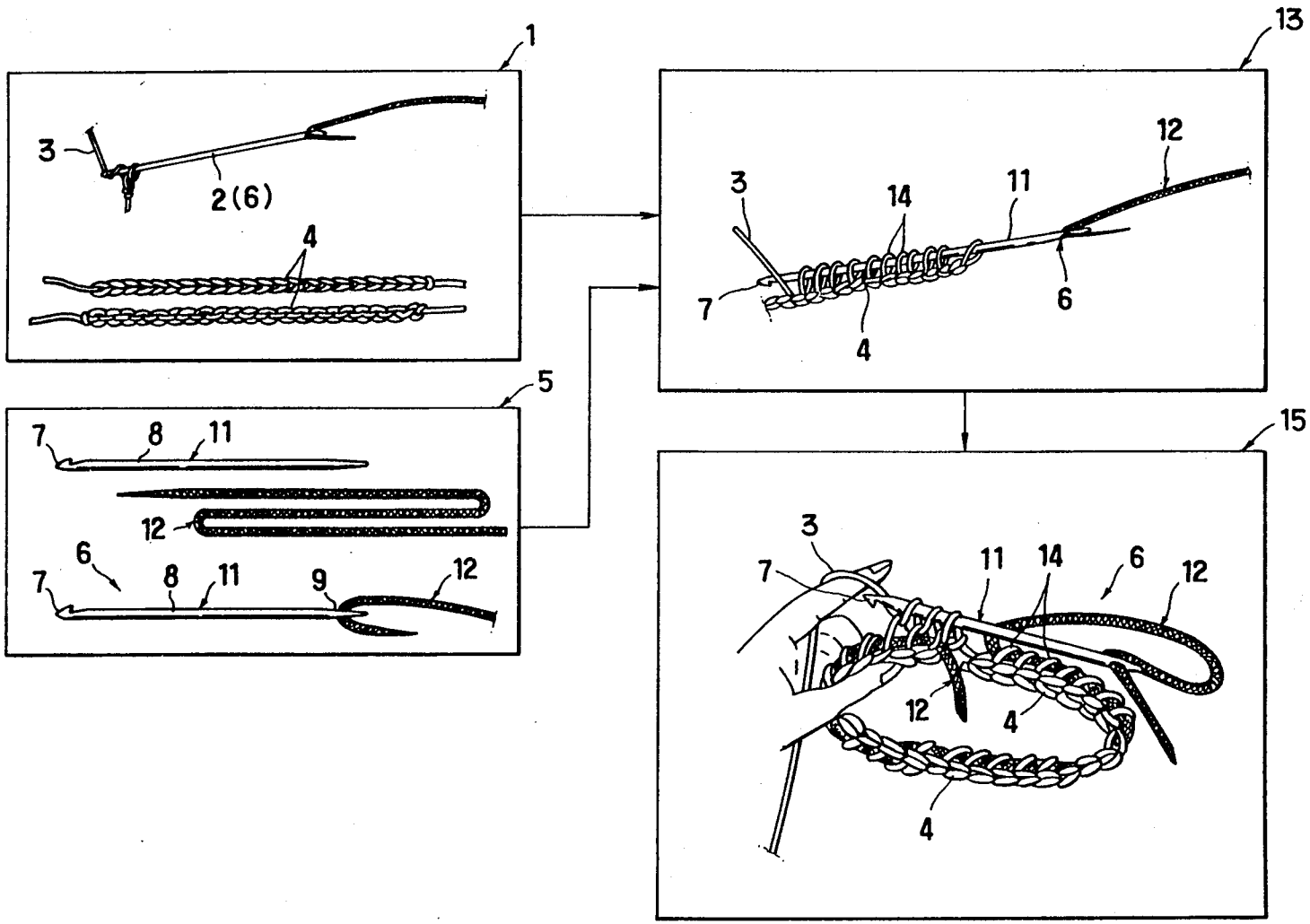
FIG. 1 is a diagram showing the steps of one embodiment of the present invention.
Figure 2:
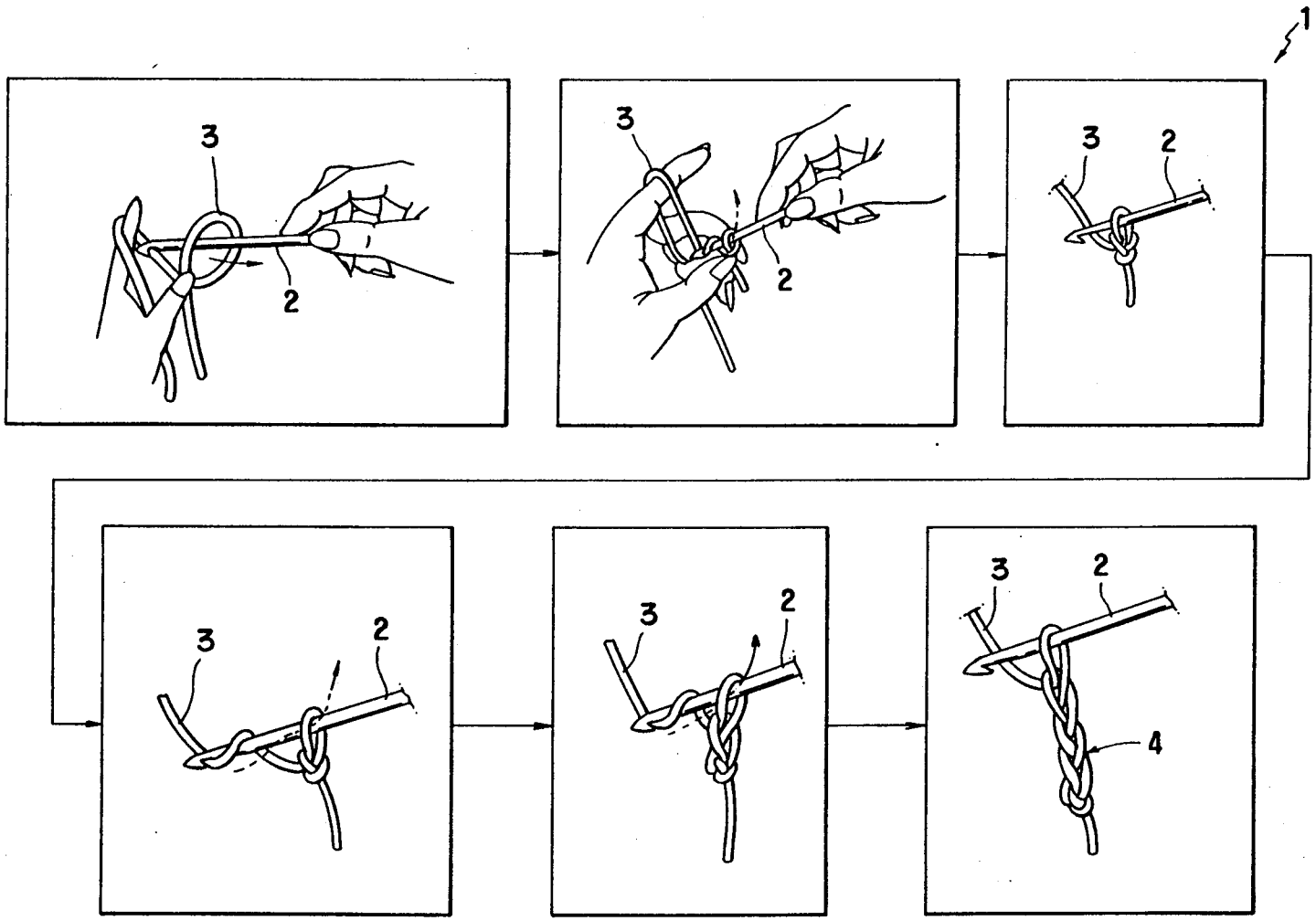
FIG. 2 is an explanatory view showing a cast-on step.

The primary method of the present invention is illustrated in FIGS. 1 to 6. In FIG. 1, numeral 1 denotes a cast-on step for making a given number of chain stitches 4 of knitting thread 3 with a crochet hook 2. The foundation row of the chain stitches 4 at step 1 may be knitted by the manner shown in FIG. 2 or a known crochet method with a conventional crochet hook 2.

Figure 3:
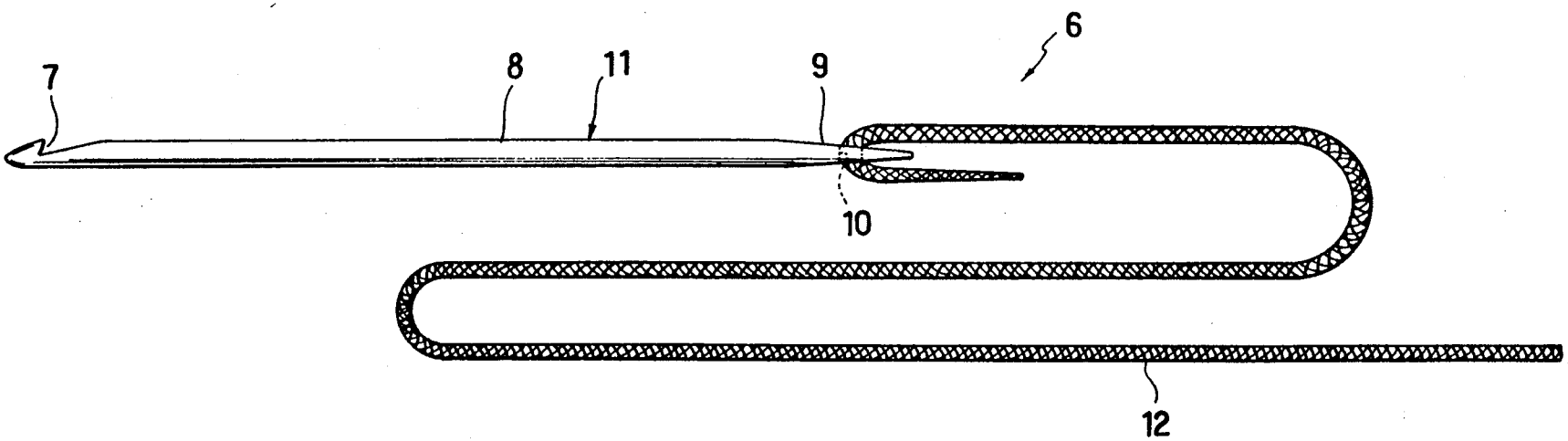
FIGS. 3 and 4 are explanatory views showing a knitting needle.
Figure 4:
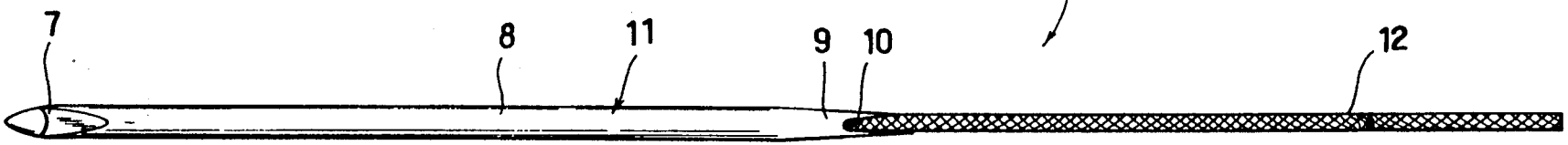

Step 5 shows the setting of a knitting needle 6 and more particularly, the fitting of a knitting extension to a hooked needle 11. As best shown in FIGS. 3 and 4, the knitting needle 6 comprises a needle body 8 having a hook 7 arranged at the distal end thereof, a tapered region 9, a through hole 10 extending across the tapered region 9, and a knitting extension 12 of flexible material having one end inserted into the through hole 10 of the hooked needle 11.

The front end of the knitting extension 12 may be tapered by forming it with cement to a sharp point for ease of insertion into the through opening 10 of the needle body 8. Also, it may be protected with a fastening ring, such as employed on a shoe lace, for the same purpose.

The knitting stick 12 is preferably provided in the form of a string having a given length and a given thickness predetermined according to the shape and size of a knitted texture and/or thread to be used for knitting.

The string of the knitting extension 12 may be of any type of flexible material and more preferably, is a rope of tubular shape formed by twisting a multiplicity of finer strands.

Alternatively, it may be formed or a flexible wire of synthetic resin.

Figure 5:
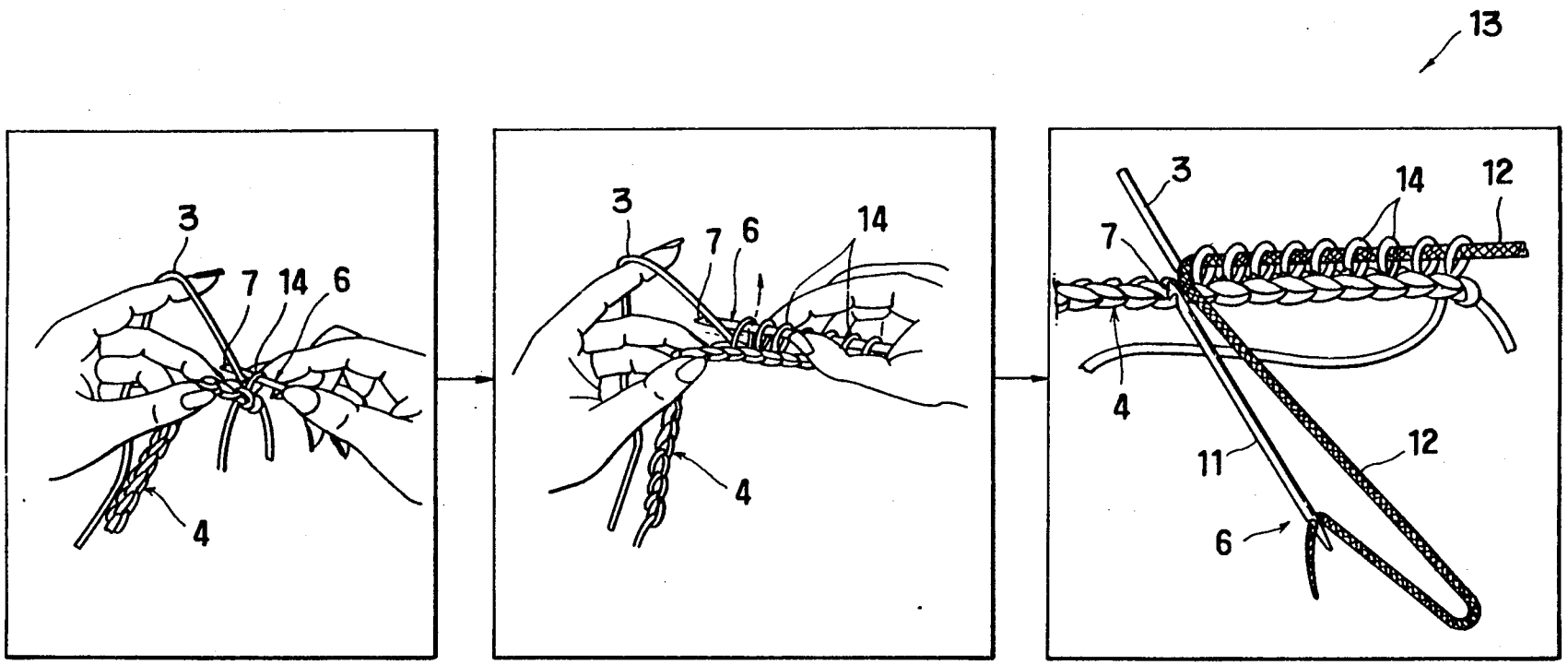
FIG. 5 is an explanatory view showing a first knitting step.

The first knitting step 13 is comprised of interlooping thread by threading over and drawing through each stitch across the foundation row of the chain stitches 4 knitted in the cast-on step 1, as shown in FIG. 5. More specifically, it starts by inserting the hook 7 of the hooked needle 11 of the knitting needle 6 into the first loop of the chain stitches 4 and drawing the thread 3 of the chain stitches 4 or of another material with it, forming one crochet stitch.

Then, the hook 7 of the hooked needle 11 is inserted into the second loop of the chain stitches 4 before threading over and so on. By repeating this procedure, a series of crochet stitches 14 are looped on the hooked needle 11.

As the number of loops o the hooked needle 11 is increased, the hooked needle 11 is advanced to transfer a group of the loops onto the knitting stick 12.

A first row of the crochet stitches 14 is now completed by repeating the foregoing procedure along the foundation row of the chain stitches 4 from one end to the other.

It is also a good idea to transfer each of the crochet stitches 14 from the hooked needle 11 to the knitting stick 12 upon being looped on the hooked needle 11.

Figure 6:
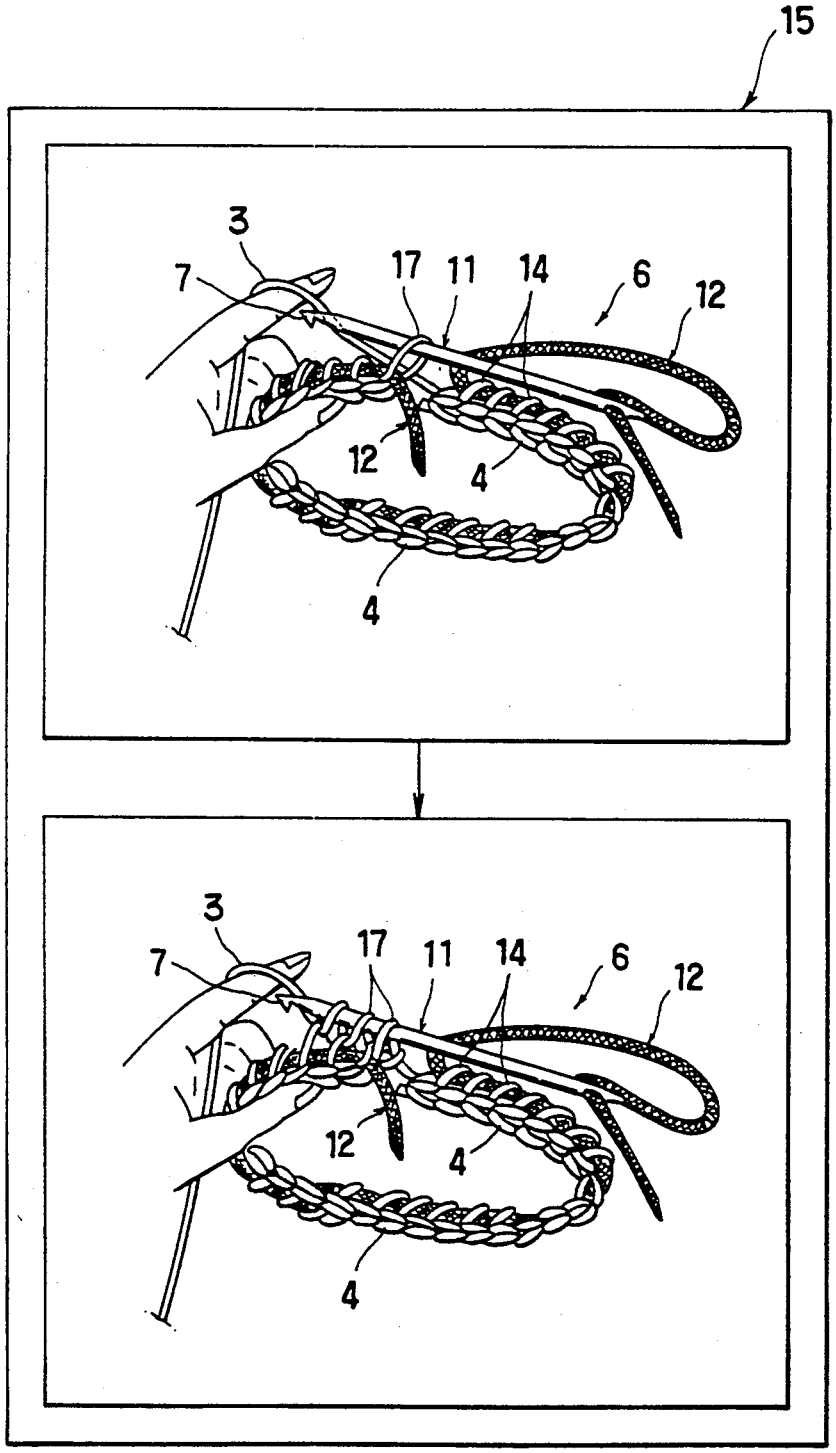
FIG. 6 is an explanatory view showing a second knitting step.

The second knitting step 15 is comprised of making a second row of crochet stitches 16 along the first row 14 by drawing the second-to-last stitch through the last loop of the first row stitches 14, which remains on the rear end of the knitting extension 12, after the first knitting step 13. More specifically, the hook 7 of the hooked needle 11 of the knitting needle 6 is inserted into the last loop of the first row stitches 14 which is carried on the rear end of the knitting extension 12 and drawing the thread 3 with the hook 7, as shown in FIG. 6.

Then, the hook 7 of the hooked needle 11 is inserted into the second loop of the stitches 14 before threading over and so on. By repeating the same procedure, a series of crochet stitches 16 are looped on the hooked needle 11.

When the number of loops on the hooked needle 11 is increased, the hooked needle 11 is advanced to transfer a group of the loops onto the knitting extension 12.

By repeating the foregoing procedure a number of times, rows of crochet stitches are made in knitting.

It is also a good idea to transfer each of the stitches 16 from the hooked needle 11 to the knitting stick 12 upon being looped on the hooked needle 11.

As the result of knitting in the foregoing method, a tubular form of knitted texture is fabricated.

Other embodiments of the present invention will then be described with reference to FIGS. 7 to 14. Similar to the first embodiment, the same components are represented like numerals and will not be explained for simplicity.

Figure 7:
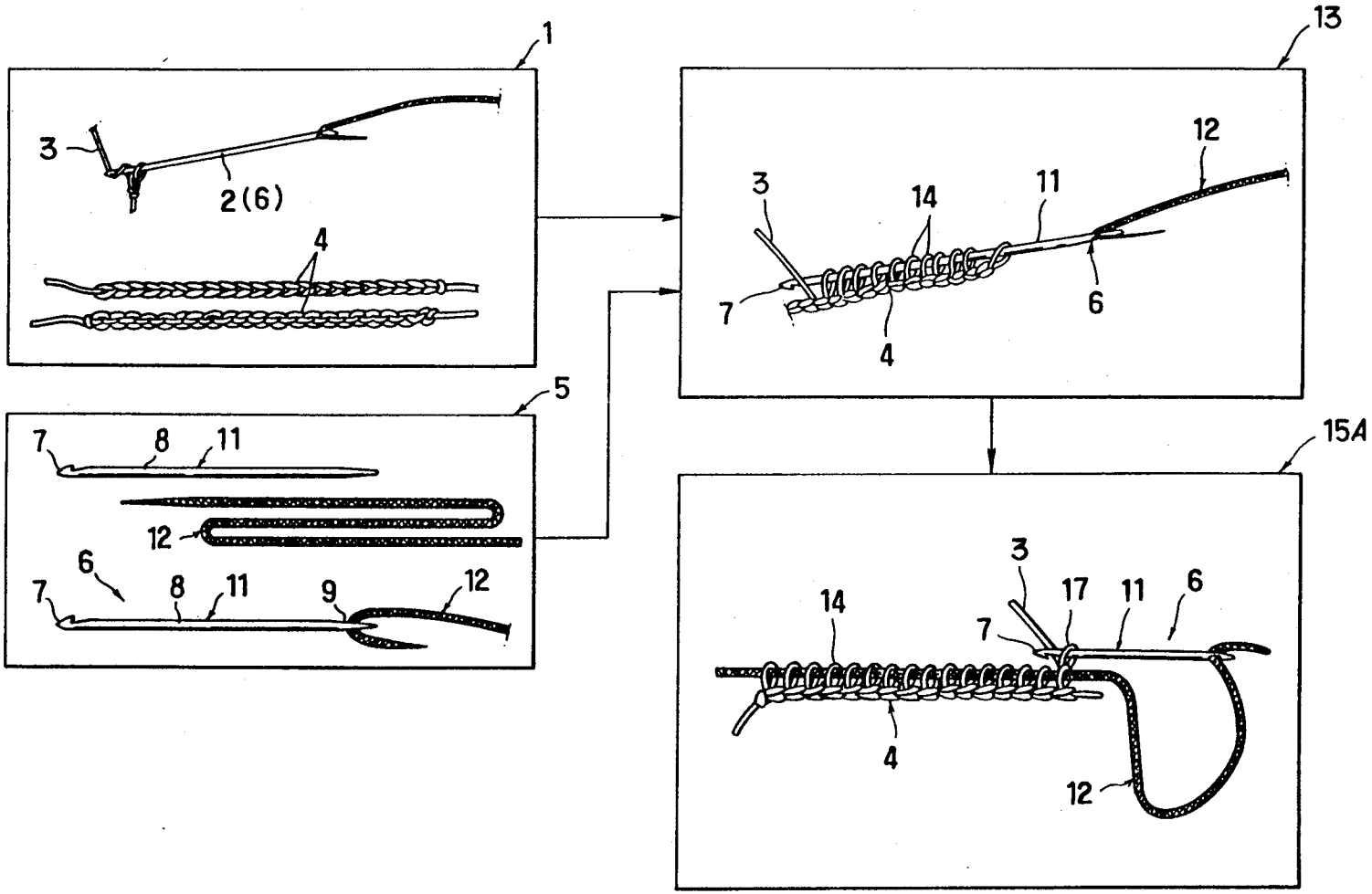
FIGS. 7 and 8, 9, 10, 11 and 12, and 13 and 14 are explanatory views showing different embodiments of the present invention respectively.
Figure 8:
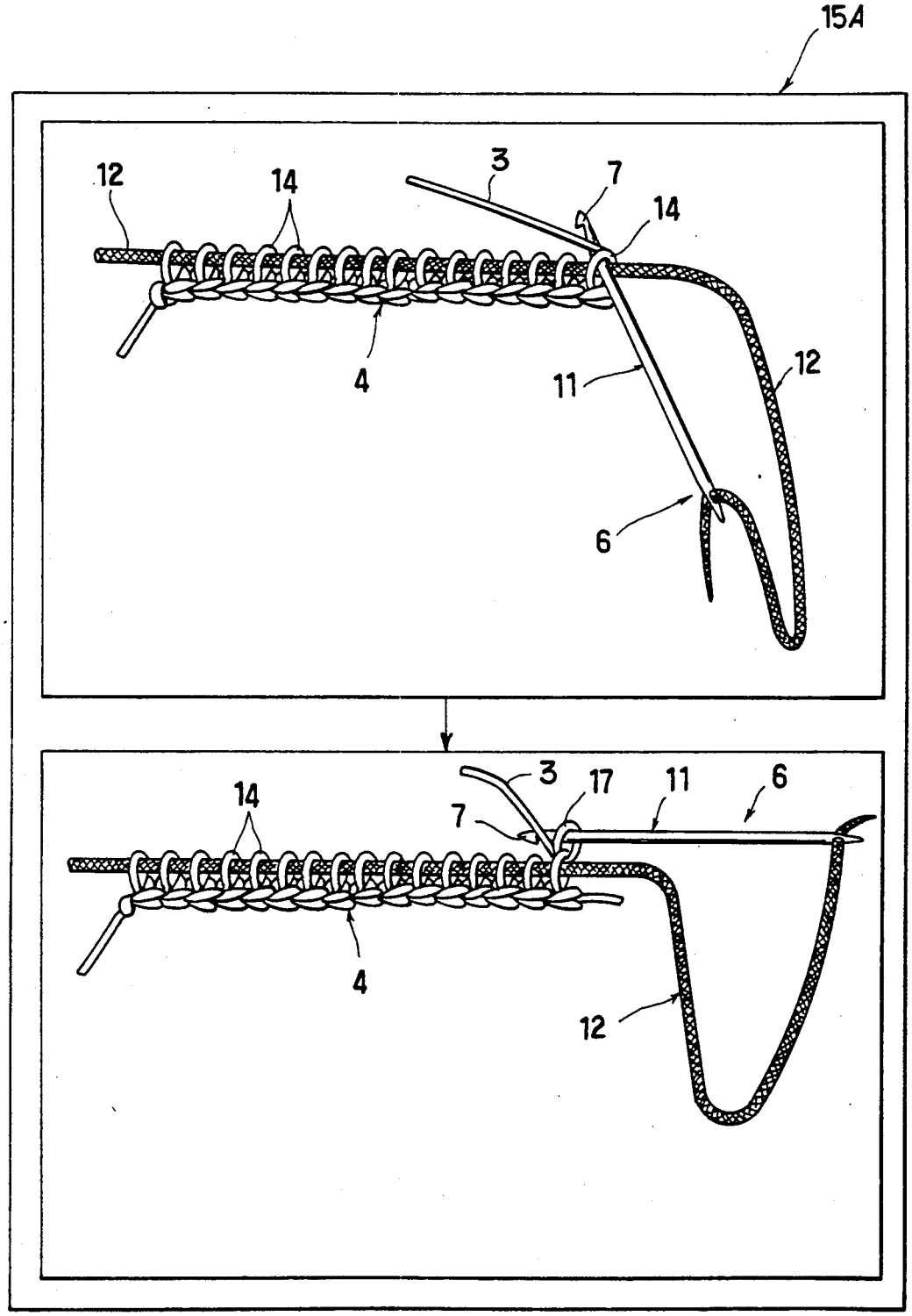

The embodiment shown in FIGS. 7 and 8 is different from the primary method, in which after the first knitting step 13, the first row of the stitches 14 is turned over. Then, a second knitting step 15A starts by inserting the hook 7 of the hooked needle 11 of the knitting needle 6 through the last loop of the stitches 14 and drawing the thread 3 of the preceding loop for putting a crochet stitch of the second row 17 on the hooked needle 11. A succession of the stitches 17 looped on the hooked needle 11 are transferred to the knitting stick 12 as new loops are developed. This method of knitting with a reverse movement for each row of stitches will provide the same effect as of in the first embodiment.

Figure 9:
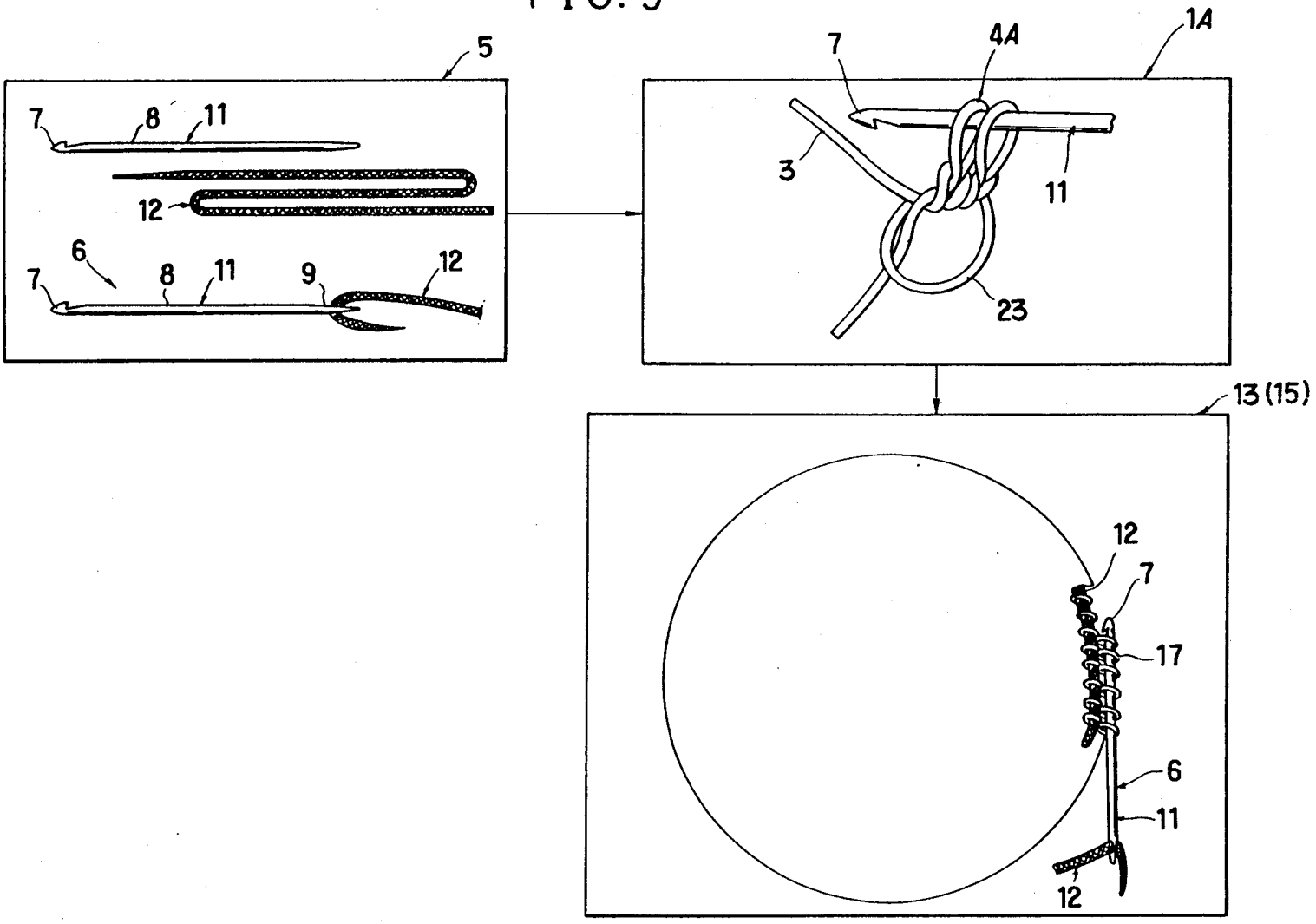

Another method illustrated in FIG. 9 includes, unlike the first described method, a cast-on step 1A of knitting a row of chain stitches 4A in a circle by forming the end of the thread 3 into a loop 23, making a given number of stitches 4A with the thread 3 along the loop 23 on the hooked needle 11, transferring the foundation row of the chain stitches 4A from the hooked needle 11 to the knitting stick 12, and closing the loop 23. After the cast-on step 1A, the first and second knitting steps 13 and 15 are carried out to fabricate a disk form of knitted texture.

Figure 10:
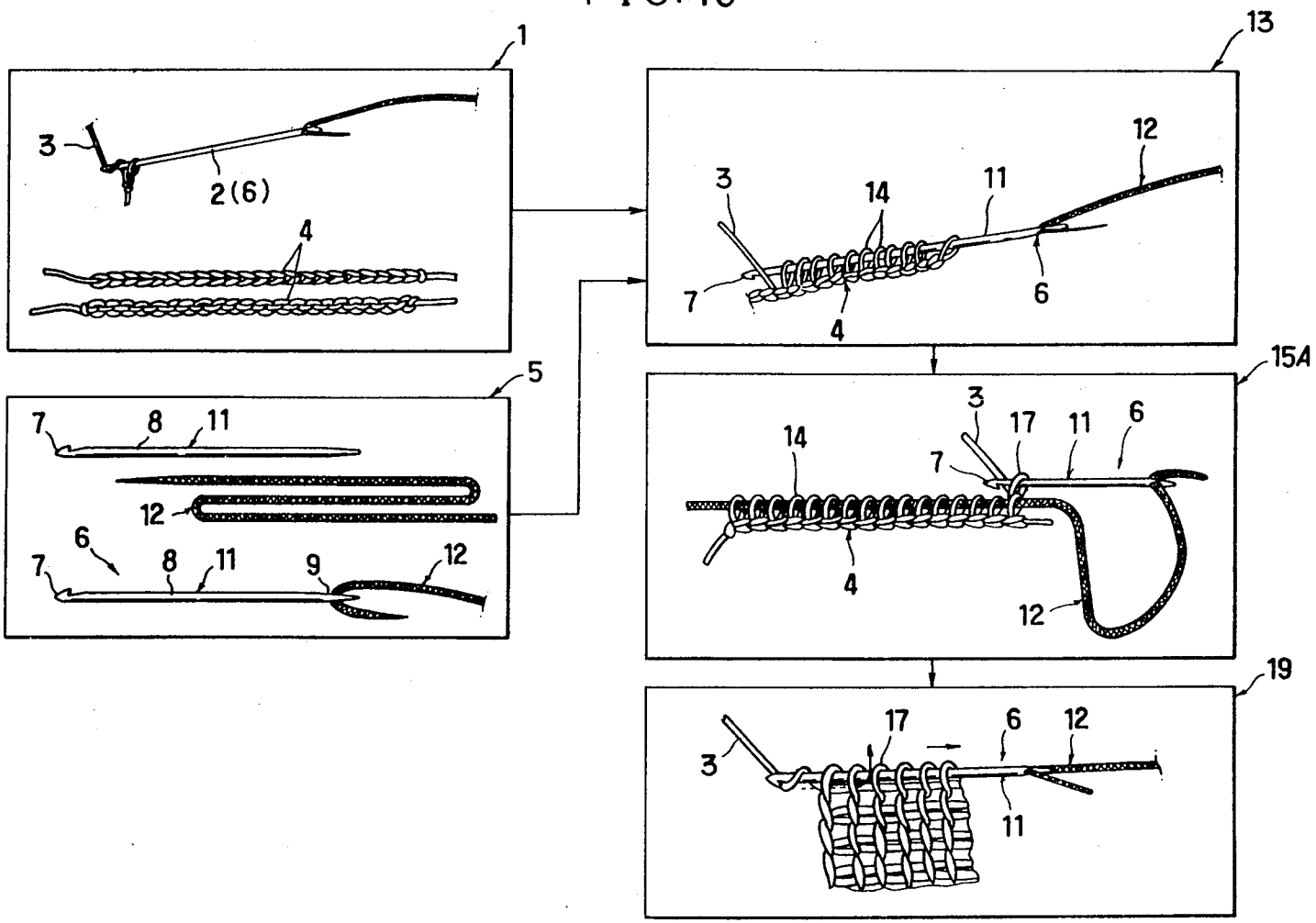

FIG. 10 illustrates a further method which, unlike the method shown in FIGS. 7 and 8, includes a third knitting step 19 for knitting a succession of backward stitches 18, after the second knitting step 15A, by moving the knitting needle 6 backward and interlooping with thread 3 while dropping each stitch 16 from the hooked needle 11. This procedure will also provide the same effect.

Figure 11:
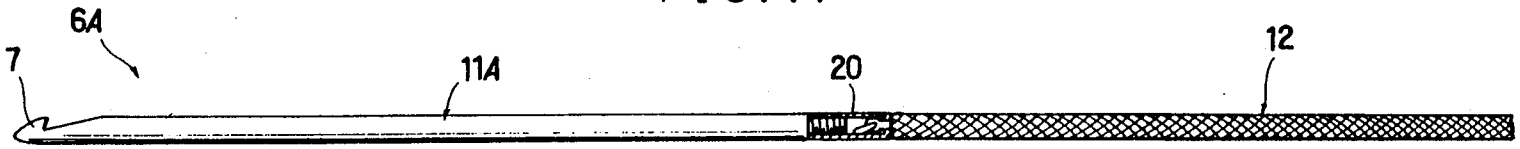
Figure 12:
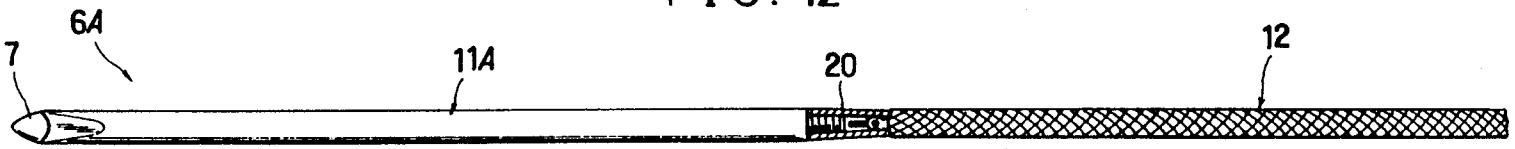

The embodiment of the present invention shown in the form of a knitting needle 6A in FIGS. 11 and 12 is different from that of the first described method, in which the knitting extension 12 of flexible string material is fixedly coupled by a fixture 20 to the rear end of a hooked needle 11A which has a hook 7 at the other end. This knitting needle 6A is used with equal success.

Figure 13:
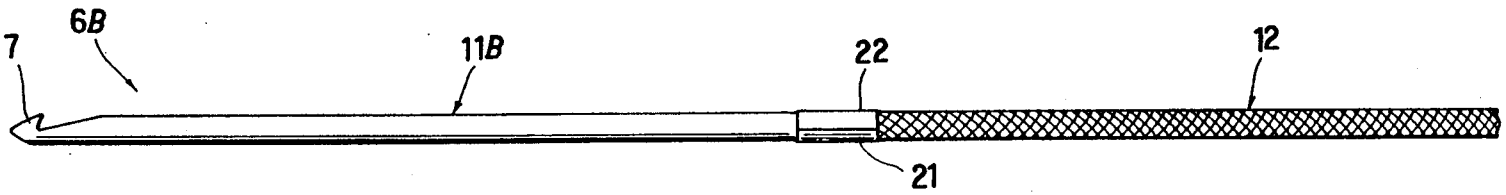
Figure 14:
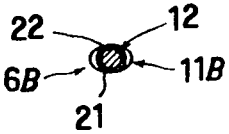

A further embodiment of the present invention shown in the form of a knitting needle 6B in FIGS. 13 and 14 is different from that of the first described method, in which a hooked needle 11B has a knitting stick retainer 21 of semicircular shape provided at the rear end thereof for retaining one end of the knitting extension 12 with the help of a tape 22. This knitting needle 6B is also used with equal success as that of the first described embodiment.

As set forth above, the present invention provides the following advantages.

(1) The method of knitting of the present invention is comprised of: a cast-on step for making a given number of chain stitches of thread with the use of a hooked needle; a knitting needle setting step for setting a knitting needle by inserting one end of a knitting extension, which is formed of flexible string having a length and a thickness predetermined according to the size and shape of the knitted article or the thread to be used, into a through hole arranged in the rear end of a hooked needle; a first knitting step of interlooping thread by inserting the front end of the hooked needle of the knitting needle into each chain stitch across the row of the chain stitches arranged at the cast-on step, threading over, and drawing through the chain stitch the thread of the chain stitches or of another material to form a succession of loops on the hooked needle, and transferring the loops from the hooked needle to the knitting stick. The second knitting step of interlooping thread comprises starting, after the first knitting step, by inserting the front end of the hooked needle of the knitting needle through the loop which remains on the rear end of the knitting stick, into the preceding loop, threading over, and drawing the thread to form a loop on the hooked needle, and transferring the loop or a succession of the loops from the hooked needle to the knitting stick, thus ensuring ease of knitting.

(2) As denoted in the preceding paragraph, the knitting extension of the knitting needle is formed of flexible string and can thus be bent or folded down for ease of transportation and safe in use.

(3) As denoted in paragraph (1) above, the knitting needle can be prevented from slipping off from the work being knitted.

(4) As denoted in paragraph (1) above, a tubular shape of knitted article can be fabricated with the use of one single knitting needle.

(5) As denoted in paragraph (1) above, each stitch is formed by drawing a thread with the hook of a hooked needle so that a succession of stitches can be made with ease. This also allows a person who is disabled in sight or other physical capability to enjoy knitting or crocheting.

(6) The present invention exhibits the same advantages as denoted in the paragraphs (1), (2), (3), and (5) above and also, encourages the knitting of a long article, e.g. a muffler, with a longer knitting needle in which rows of crochet stitches are arranged lengthwisely of the muffler.

What is claimed is:

1. A method of knitting comprising:

a.) incorporating a yarn, using a hooked needle, into a chain of stitches with a given number of chain stitches;

b.) a knitting extension, of flexible string having a length and a thickness predetermined according to the size and shape of an article to be knitted or the yarn to be used, into a through hole in an end opposite a hooked end of the hooked needle;

c.) interlooping a length of yarn into each of the chain stitches, of the chain of stitches, to form a succession of loops on the hooked needle and subsequently transferring the formed loops to the knitting extension; and d.) inserting the hooked end of the hooked needle through one of the formed loop, at an end of the knitting extension opposite the hooked needle, and interlooping the yarn to form a new loop on the hooked needle, forming a succession of new loops by interlooping the yarn with the successively formed loops, and subsequently transferring the new formed loops to the knitting extension; and e.) repeating step (d) to adesired length.

2. A method of knitting according to claim 1 further comprising:

f.) interlooping the yarn through previously formed loops beginning at a loop closest the hooked needle to form a reverse sucession of loops; and g. alternating steps (d) and (f) to a desired length.

* * * * *